United States Patent [19]

Seidel

[11] Patent Number: 4,533,159

[45] Date of Patent: Aug. 6, 1985

[54] WIND PROPULSION APPARATUS

[76] Inventor: John C. Seidel, 1010 State St., Alma, Mich. 48801

[21] Appl. No.: 604,999

[22] Filed: Apr. 27, 1984

[51] Int. Cl.[3] ..... A63C 3/00; A63C 11/00

[52] U.S. Cl. ..... 280/810; 114/39

[58] Field of Search ..... 280/810; 114/39.2, 102, 114/103; 441/74

[56] References Cited

U.S. PATENT DOCUMENTS

| | | | |
|---|---|---|---|
| 2,213,754 | 9/1940 | Thirring | 280/810 |
| 4,234,211 | 11/1980 | Lux | 280/810 |
| 4,311,324 | 1/1982 | Fries | 280/810 |
| 4,473,022 | 9/1984 | Eastland | 280/810 |
| 4,489,957 | 12/1984 | Holmgren | 280/810 |

FOREIGN PATENT DOCUMENTS

| | | | |
|---|---|---|---|
| 961727 | 9/1982 | U.S.S.R. | 280/810 |

*Primary Examiner*—David M. Mitchell
*Assistant Examiner*—Eric Douglas Culbreth
*Attorney, Agent, or Firm*—Learman & McCulloch

[57] ABSTRACT

Wind propulsion apparatus for a skier or skater comprises a sail secured to its upper end to a mast and having a pair of sheets at its lower end trained about guide pulleys secured to the user's boots. The sheets may be adjustably secured to retainers carried by the user. The mast has a mount at its lower end which may be supported on either of the user's feet.

12 Claims, 6 Drawing Figures

WIND PROPULSION APPARATUS

This invention relates to wind propulsion apparatus adapted for use by a skier or skater to enable him or her to be propelled across a surface by wind.

BACKGROUND OF THE INVENTION

The concept of providing a sail for use by skiers and skaters has been proposed heretofore. Examples of such proposals appear in U.S. Pat. Nos. 1,178,165; 1,859,178; 3,768,823; 3,982,766; 4,204,694; 4,234,211; and 4,311,324. Although the apparatus disclosed in such patents will enable one to utilize the wind for propulsion purposes, some of the devices are cumbersome, others are relatively unadjustable, and still others appear to make difficult maintaining one's balance during the making of adjustments or upon gusting of the wind.

SUMMARY OF THE INVENTION

Apparatus constructed in accordance with the invention comprises a variable length mast provided at one end with means for connection to one end of a three-sided sail and at its other end with means for supporting the mast on either foot of a person equipped with skis or roller or ice skates. To the sail is secured the corresponding end of a pair of sheets each of which has an intermediate portion extending through guide points secured to the skier's or skater's boots. The opposite end of each sheet is free and may be removably anchored to a retainer carried by the user or held in one of the user's hands. The arrangement is such that the height of the mast may be varied, the support of the mast may be varied, and the position of the sail may be varied by manipulation of the sheets.

THE DRAWINGS

A presently preferred embodiment of propulsion apparatus constructed in accordance with the invention is disclosed in the following description and in the accompanying drawings in which.

DETAILED DESCRIPTION

Figure 2:
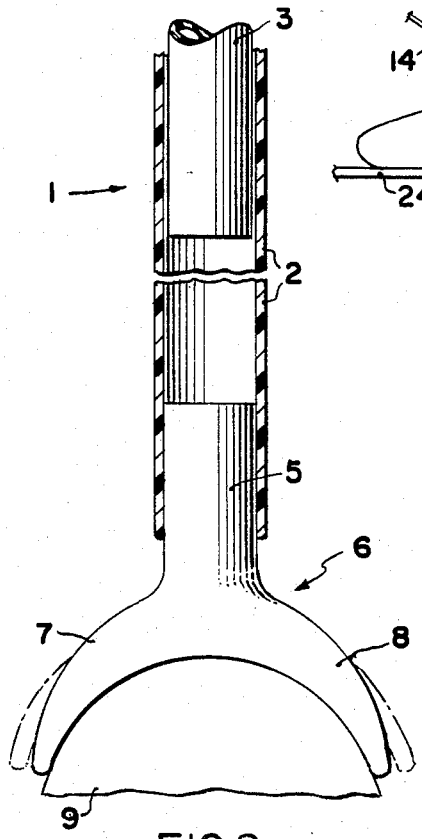
FIG. 2 is a fragmentary, partly elevational and partly sectional view, on a greatly enlarged scale, of the lower end of the mast.
Figure 4:
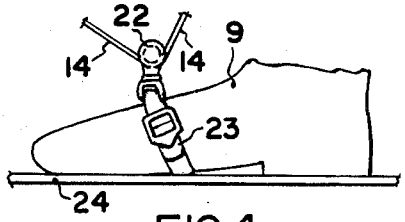
FIG. 4 is a fragmentary, side elevational view, on an enlarged scale, of one of the skier's boots and illustrating one of the sheet guides.
Figure 3:
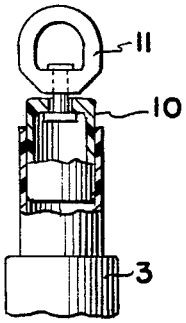
FIG. 3 is a view similar to FIG. 2, but illustrating the upper end of the mast.
Figure 5:
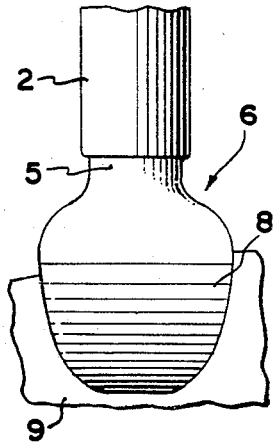
FIG. 5 is a side elevational view of the lower end of the mast and illustrating the manner in which it embraces the skier's boot.
Figure 6:
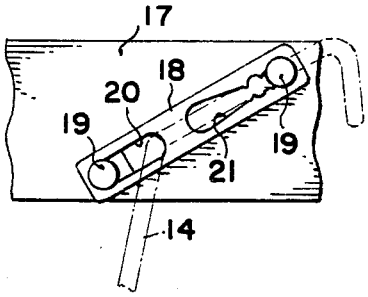
FIG. 6 is a fragmentary elevational view illustrating one of the sheet retainers.

Wind propulsion apparatus constructed in accordance with a preferred embodiment of the invention comprises an adjustable length mast 1 having a lower, tubular section 2 within which is telescoped an upper, tubular section 3. An adjustable friction clamp 4 of conventional construction threadedly encircles the section 2 adjacent its upper end and may be manipulated so as to enable the section 3 to be retained in any selected position of adjustment axially of the member 2. At its lower end the section 2 frictionally accommodates a shank 5 of a saddle-shaped mount 6 having a pair of diverging arms 7 and 8 that are adapted to embrace the instep of a person's boot 9. Preferably, the arms 7 and 8 are flexible, as is indicated by the dash lines in FIG. 2, so as readily to accommodate boots of different size. The length of the arms 7 and 8 preferably is such that substantial clearance exists between the free ends of the arms and the ground, ice, or other surface that is traversed by the person. The length of each leg 7 and 8 is such as to minimize the likelihood of its free end engaging the ground or other surface on which the user stands. However should the free end of one of the arms 7 or 8 engage the ground, the flexibility of such arm will enable the arm to yield.

At the upper end of the mast 1 is a frictionally retained plug 10 which accommodates a swivelly mounted eye 11.

The apparatus also includes a three-sided sail 12, preferably of the spinnaker type. The sail thus has three corners 13 each of which is equipped with a grommet. One of the corners 13 is connected to the swivel 11 at the upper end of the mast 1 by a suitable connector 11a, whereas each of the other corners is connected to one end of an elongate, flexible sheet 14. The sail 12 may be formed of any suitable material such as nylon or similar fabric, but it is preferred that at least a portion 16 of the sail body 15 be formed of a transparent material such as a sheet of thin, pliable, plastic material.

The apparatus includes a belt 17 that is adapted to encircle the waist of the user. The belt 17 is provided with a pair of retainers 18 of known construction which are secured to the belt by rivets 19 or the like and which are provided with openings 20 and 21 through which the free end of a sheet 14 may be threaded. The opening 21 preferably tapers to a width less than the thickness of the sheet 14, thereby enabling the sheet releasably to be secured by a retainer in any selected position of adjustment.

An intermediate portion of each sheet 14 is trained around a guide pulley 22 that is carried by a strap 23 which may be applied to the boot 9 of the user.

Figure 1:
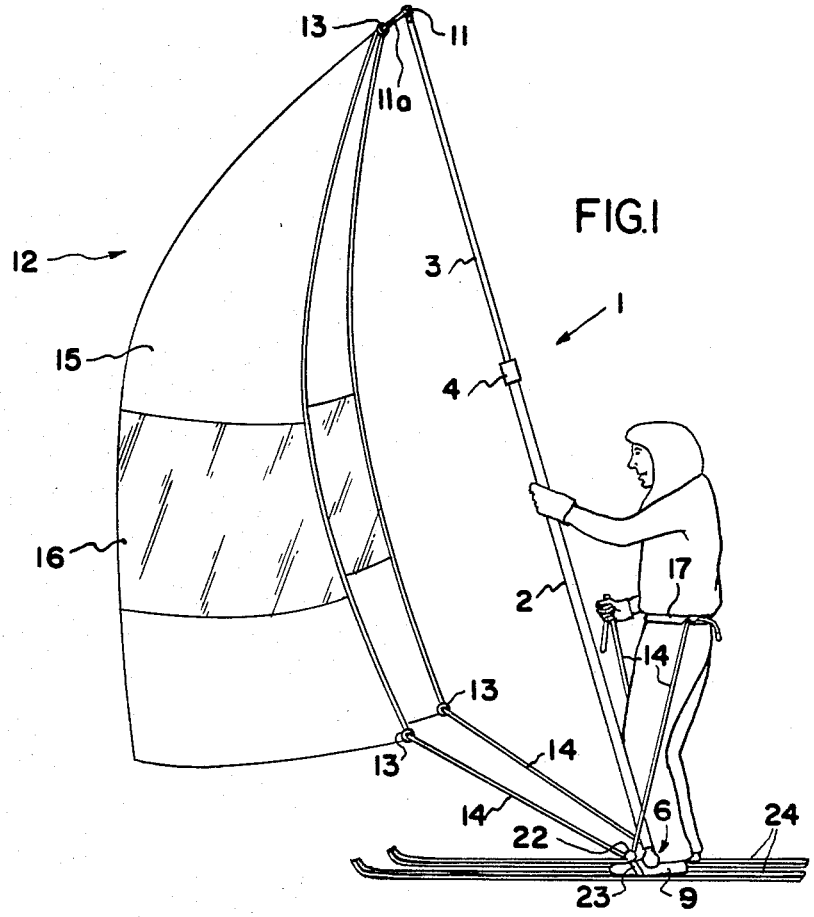
FIG. 1 is a side elevational view illustrating the apparatus in use.

FIG. 1 illustrates the apparatus in use by a person equipped with skis 24, but it should be understood that the apparatus is equally capable of use by a person equipped with ice or roller skates.

As shown in FIG. 1, the mast 1 is in an extended, generally upright condition with the mount 6 resting on the instep of the user's left boot and held by the user's left hand. The left hand sheet 14 passes around the guide pulley 22 attached to the user's left boot and its free end is anchored in the left-hand retainer 18. The right-hand sheet 14 is trained around the guide pulley secured to the user's right boot and the free end of the right-hand sheet is held in the user's right hand. The free end, however, could be secured to the right-hand retainer 18, if desired.

In the arrangement of the parts as shown in FIG. 1, the skier may be propelled from right to left by a wind blowing in the same general direction. The transparent section 16 of the sail body 15 enables the skier to view the terrain ahead of him.

Apparatus according to the invention enables the sail to be controlled in numerous ways. For example, the mast 1 may be extended or retracted, thereby varying considerably the arch or bow of the sail. Further, manipulation of the sheets 14 will enable the lower corners 13 of the sail to be adjusted toward or away from the skier's boots. Further, the user may tilt the mast 1 fore and aft or left to right to take advantage of changes in wind direction. In addition, the user may shift the mast from the left foot to the right foot when desired, and the saddle-like shape of the mast 6 makes such a shift of the mast quite easy without the skier's even having to watch the mount 6 during the shifting movement.

The disclosed embodiment is representative of a presently preferred form of the invention, but is intended to be illustrative rather than definitive thereof. The invention is defined in the claims.

I claim:

1. Wind propulsion apparatus for propelling a person equipped with skis or skates across a surface, said apparatus comprising a mast; a sail; means for connecting said sail to one end of said mast; means carried by said mast at its other end for supporting said mast in a generally upright condition; first and second guide means; mounting means for mounting said guide means on such person's feet; and first and second sheets secured to said sail and extending through and beyond the respective guide means for manipulation by such person.

2. Apparatus according to claim 1 wherein said mast is adjustable in length.

3. Apparatus according to claim 1 wherein said sail is a spinnaker.

4. Apparatus according to claim 1 wherein said sail has at least one transparent body portion.

5. Apparatus according to claim 1 wherein the means for supporting said mast at its other end comprises a saddle-shaped member adapted to straddle either foot of such person.

6. Apparatus according to claim 1 wherein each of said guides comprises a pulley.

7. Apparatus according to claim 1 wherein each of said mounting means comprises a strap secured to a foot of such person and to which the associated guide means is secured.

8. Apparatus according to claim 1 wherein the means connecting said sail to said mast is swivelable.

9. Apparatus according to claim 1 including anchor means for adjustably retaining the respective sheets in a selected position of adjustment relative to its associated guide means.

10. Apparatus according to claim 1 wherein the means for supporting said mast at its other end comprises a saddle-shaped member adapted to straddle either such person's feet, said member being formed of flexible material.

11. Wind propulsion apparatus for propelling a person equipped with skis or skates across a surface, said apparatus comprising an elongate mast; a three-cornered sail; means connecting one corner of said sail to said mast at one end thereof; means at the other end of said mast for supporting the latter on a selected one of either of the feet of such person; first and second guide means; means for securing said first and second guide means to the respective feet of such person; first and second sheets secured at corresponding ends to the remaining two corners of said sail and extending to and beyond the respective guide means; and anchor means for releasably securing said sheets in selected positions of adjustment.

12. Apparatus according to claim 11 wherein said anchor means comprises a pair of retainers carried by a belt adapted to encircle such person's waist.

* * * * *